US008683665B2

(12) United States Patent
Fraze

(10) Patent No.: US 8,683,665 B2
(45) Date of Patent: Apr. 1, 2014

(54) RATCHET ADJUSTMENT SYSTEM

(75) Inventor: Gary Fraze, Big Bear City, CA (US)

(73) Assignee: Duraflex Hong Kong Limited, Sheung Wan (HK)

( * ) Notice: Subject to any disclaimer, the term of this patent is extended or adjusted under 35 U.S.C. 154(b) by 266 days.

(21) Appl. No.: 13/343,144

(22) Filed: Jan. 4, 2012

(65) Prior Publication Data

US 2012/0174355 A1 Jul. 12, 2012

Related U.S. Application Data

(63) Continuation-in-part of application No. 12/930,534, filed on Jan. 10, 2011, now abandoned.

(51) Int. Cl.

| | |
|---|---|
| ***A44B 11/10*** | (2006.01) |
| ***A44B 11/02*** | (2006.01) |
| *A43C 11/12* | (2006.01) |

(52) U.S. Cl.

USPC ..... 24/593.11; 24/DIG. 44

(58) Field of Classification Search

USPC ..... 24/68 A, 68 E, 68 SK, 590.1, 593.11, 24/634, DIG. 43, DIG. 44, DIG. 47, DIG. 48

See application file for complete search history.

(56) References Cited

U.S. PATENT DOCUMENTS

| | | | | | |
|---|---|---|---|---|---|
| 637,331 | A | * | 11/1899 | Flicek | 24/593.11 |
| 1,507,216 | A | * | 9/1924 | Stockton | 24/595.1 |
| 2,002,046 | A | | 5/1935 | Scholtes | |
| 2,105,213 | A | * | 1/1938 | Clark | 24/595.1 |
| 2,507,322 | A | * | 5/1950 | Smith | 2/97 |
| 2,517,400 | A | * | 8/1950 | Merritt | 2/97 |
| 2,636,239 | A | * | 4/1953 | Vizner | 24/589.1 |
| 2,743,684 | A | * | 5/1956 | Elsner | 410/105 |
| 2,967,342 | A | * | 1/1961 | Henry | 24/593.11 |
| 3,344,749 | A | * | 10/1967 | Bass | 410/105 |
| 3,939,729 | A | | 2/1976 | Brockelsby | |
| 3,956,802 | A | | 5/1976 | Kanzaka | |
| 4,282,634 | A | * | 8/1981 | Krauss | 24/323 |
| 4,317,262 | A | * | 3/1982 | Wells, Jr. | 24/16 PB |
| 4,577,375 | A | * | 3/1986 | Beaussant | 24/593.1 |
| 4,646,401 | A | * | 3/1987 | Morell | 24/68 SK |
| 4,676,535 | A | * | 6/1987 | Mautner | 292/320 |
| 4,800,595 | A | * | 1/1989 | Askew | 2/270 |

(Continued)

OTHER PUBLICATIONS

International Search Report in PCT/US12/20127, May 4, 2012.

(Continued)

*Primary Examiner* — Robert J Sandy
*Assistant Examiner* — Louis Mercado
(74) *Attorney, Agent, or Firm* — Collard & Roe, P.C.

(57) ABSTRACT

An adjustment system for adjusting the width of a cuff has an elongated adjustment strip having a set of longitudinally extending teeth. Each tooth has a forward side and a rearward side. A length of each forward side is greater than a length of each of the rearward sides so that an angle between a longitudinal axis of the strip and the forward side is less than an angle between the longitudinal axis and the rearward side of each tooth. There is a locking mechanism formed by a base plate having a locking device on an underside and a guide for slidably connecting the locking mechanism to the strip. The tooth and the locking device are configured so that the locking device can be moved forward along the strip using only a small amount of force, and can then be moved rearward using a larger amount of force.

5 Claims, 12 Drawing Sheets

(56) References Cited

U.S. PATENT DOCUMENTS

| | | | | |
|---|---|---|---|---|
| 4,903,381 | A * | 2/1990 | Fohl | 24/587.12 |
| 4,916,779 | A * | 4/1990 | Terada et al. | 24/593.1 |
| 4,976,017 | A * | 12/1990 | Frano | 24/578.1 |
| 5,181,300 | A * | 1/1993 | Schwarz | 24/578.1 |
| 5,625,926 | A * | 5/1997 | Berrezouga | 24/265 CD |
| 5,675,875 | A * | 10/1997 | Servatius | 24/704.1 |
| 5,687,455 | A * | 11/1997 | Alexander | 24/16 PB |
| 6,108,821 | A * | 8/2000 | Malsoute | 2/321 |
| 6,226,839 | B1 * | 5/2001 | Sayegh | 24/16 PB |
| 6,250,651 | B1 | 6/2001 | Reuss et al. | |
| 6,588,125 | B2 | 7/2003 | Proctor, Sr. | |
| 6,684,667 | B2 | 2/2004 | Young | |
| 6,715,974 | B2 * | 4/2004 | Stotzer et al. | 410/105 |
| 7,100,248 | B2 * | 9/2006 | Crook | 24/16 PB |
| 7,117,569 | B2 * | 10/2006 | Bledsoe | 24/593.11 |
| 7,210,252 | B2 | 5/2007 | Morrow et | |
| 7,246,803 | B2 | 7/2007 | Sauter et al. | |
| 7,434,583 | B2 * | 10/2008 | Win | 128/881 |
| 7,703,151 | B2 * | 4/2010 | Blauer et al. | 2/270 |
| 2006/0174459 | A1 | 8/2006 | Bledsoe | |
| 2010/0281661 | A1 | 11/2010 | Harada et al. | |
| 2012/0174291 | A1 * | 7/2012 | Fraze | 2/270 |

OTHER PUBLICATIONS

Written Opinion of the International Searching Authority in PCT/US12/20127, May 4, 2012.

* cited by examiner

RATCHET ADJUSTMENT SYSTEM

CROSS REFERENCE TO RELATED APPLICATIONS

This application is a continuation-in-part under 35 U.S.C. §120 of U.S. patent application Ser. No. 12/930,534 filed on Jan. 10, 2011, the disclosure of which is herein incorporated by reference.

BACKGROUND OF THE INVENTION

1. Field of the Invention

This invention relates to an adjustment system for increasing and decreasing the circumference of an article, such as a sleeve cuff or footwear. In particular the invention relates to an adjustment system using a ratcheting device to adjust the width of the article.

2. The Prior Art

In some articles of apparel, such as jacket sleeve cuffs and pant cuffs in athletic clothing, the cuff width needs to be adjusted to be more secure around the wrist or ankle of the user. Traditionally, this adjustment was accomplished via a strap that could be tightened around the cuff, either with a buckle or a hook-and-loop type closure, such as VELCRO.®

The disadvantage to using a buckle is that the buckle is very cumbersome to adjust with only one hand, which is necessary in the case of a sleeve cuff. The disadvantage to using the hook and loop type closure is that the rough surfaces on the closure parts attract a significant amount of debris, which can be unsightly and decrease the adhesiveness of the parts.

SUMMARY OF THE INVENTION

It is therefore an object of the invention to provide an adjustment system that is simple to operate with one hand and which remains free of dirt and debris.

This object is accomplished by an adjustment system comprising an elongated adjustment strip mounted on a cuff parallel to the edge of the cuff. There are a set of generally triangular teeth extending longitudinally along the strip. The teeth are formed as a ratchet system so that each tooth has a forward side facing a forward direction and a rearward side facing a rearward direction. The length of each of the forward sides is greater than a length of each of the rearward sides so that an angle created between a longitudinal axis of the elongated adjustment strip and the forward side is less than an angle between the longitudinal axis and the rearward side of each tooth.

There is locking mechanism mounted to a strap that is attached to the cuff. The locking mechanism is formed by a base plate having a locking device extending from an underside thereof and a guide for slidably connecting the locking mechanism to the elongated adjustment strip. The teeth of the strip are configured so that the locking device can be moved along the strip in the forward direction with only a small amount of force required, and can then be moved in the rearward direction using a larger amount of force. This is because the locking device must flex to a lower degree when moved against the forward side of the teeth, having the lower angle, than when moved backwards against the rearward side of the teeth, which have a much steeper angle to overcome.

The guides can be formed by brackets extending below the bottom surface of the base plate. The brackets engage under the edges of the elongated strip and keep the locking mechanism connected to the elongated strip during the adjustment process. There can be stops mounted at one or both ends of the elongated strip to prevent disengagement of the locking mechanism from the strip.

In one embodiment, there is a cover plate connected to a top surface of the base plate. A strap or other piece of fabric can be attached to the locking mechanism between the cover plate and the base plate. To keep the strap in position, there can be a set of strap-gripping teeth disposed around the underside of the cover plate and top side of the base plate.

One advantage of the invention is that the mechanism can be adjusted easily using only one hand. All that is required is to push the locking mechanism along the elongated adjustment strip with the minimum amount of force required for either the forward or rearward direction. To facilitate this adjustment, the top side of the cover plate can be equipped with a series of raised ridges. These ridges prevent fingers from slipping on the cover plate during adjustment, even when the user is wearing gloves.

In one embodiment, the teeth are located along longitudinal edges of the elongated adjustment device and the locking device comprises two longitudinally extending springs arranged on the base plate so as to engage the teeth when the locking device is moved along the elongated adjustment strip. Here, the strip is attached to the cuff only along the longitudinal axis of the strip, so that the teeth of the strip are not connected to the cuff. This way, the brackets of the locking device can slide under the teeth and keep the locking device in contact with the strip at all times.

In another embodiment, the teeth are facing upward along an expanse of the elongated adjustment strip, and the locking device comprises a resilient arm that engages the teeth when the locking mechanism is slid along the elongated adjustment strip. In this embodiment, there can be one or multiple rows of teeth along the strip. The brackets on the base plate can engage around edges of the strip to allow the locking mechanism to slide along the strip.

In another embodiment, the adjustment strip has a plurality of gears along an expanse of the adjustment strip, disposed along the longitudinal expanse of the strip, with a guide channel in between. The gears are positioned on supports that raise them above the adjustment strip. Each support is wider at its longitudinal ends than in the middle, creating an indentation in the middle of each support, facing the longitudinal sides of the strip. The locking device is disposed on a base and consists of a guide ridge running along the center of the base, and a plurality of brackets disposed on either side of the ridge. The brackets each have an engaging tooth aimed inwardly toward the guide ridge. The gears can be fed into the locking device so that the ridge runs in the guide channel and the teeth of the brackets engage the supports under the gears to keep the strip and base connected. The gears have a wide top section that rests on top of the teeth of the brackets to keep the strip and base connected. The brackets are configured so that it is easier to slide the strip in a forward direction into the locking device rather than backwards out of the locking device. This is accomplished in this embodiment by the teeth of the brackets, which are formed as a ratchet system so that each tooth has a forward side facing a forward direction and a rearward side facing a rearward direction. The length of each of the forward sides is greater than a length of each of the rearward sides so that an angle created between a longitudinal axis of the elongated adjustment strip and the forward side is smaller than an angle between the longitudinal axis and the rearward side of each tooth.

This ratcheting system makes it easier to slide the strip and base together in the forward direction, because the bracket slides at a smaller angle than in the rearward direction, causing a more gradual build-up of tension on the bracket. Once the bracket reaches a center of each gear, the tension releases, as the indentation in the gear's center allows the bracket to expand and relax into a resting position in the indentation. Further movement in the forward direction requires a certain minimum amount of force to be applied. Movement in the backward direction requires a higher minimum amount of force, because of the larger angle of the tooth in the backward direction forces a greater initial flex of the bracket.

In one embodiment, there are at least two brackets positioned on either side of the guide ridge, and the gears are arranged in two parallel rows in on the strip.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
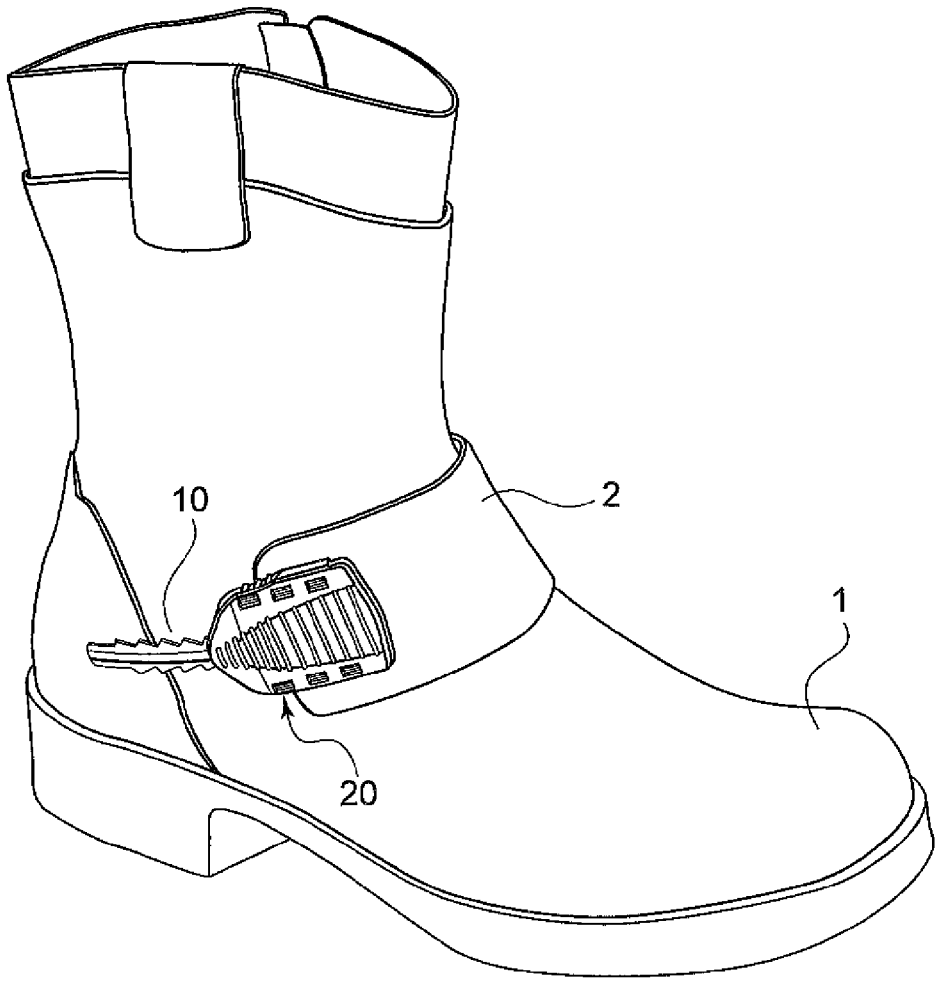
FIG. 1 shows a boot having one embodiment of the adjustment system of the invention mounted thereon.

Referring now in detail to the drawings, FIG. 1 shows a view of the view of the system according to the invention installed on a boot 1. The system comprises an elongated adjustment strip 10 and a locking mechanism generally designated as 20 attached to a strap 2 of boot 1. Locking mechanism 20 slides along adjustment strip 10 to tighten or loosen boot 1 as desired. The structure and function of the system is explained below with reference to the remaining Figures.

Figure 3:
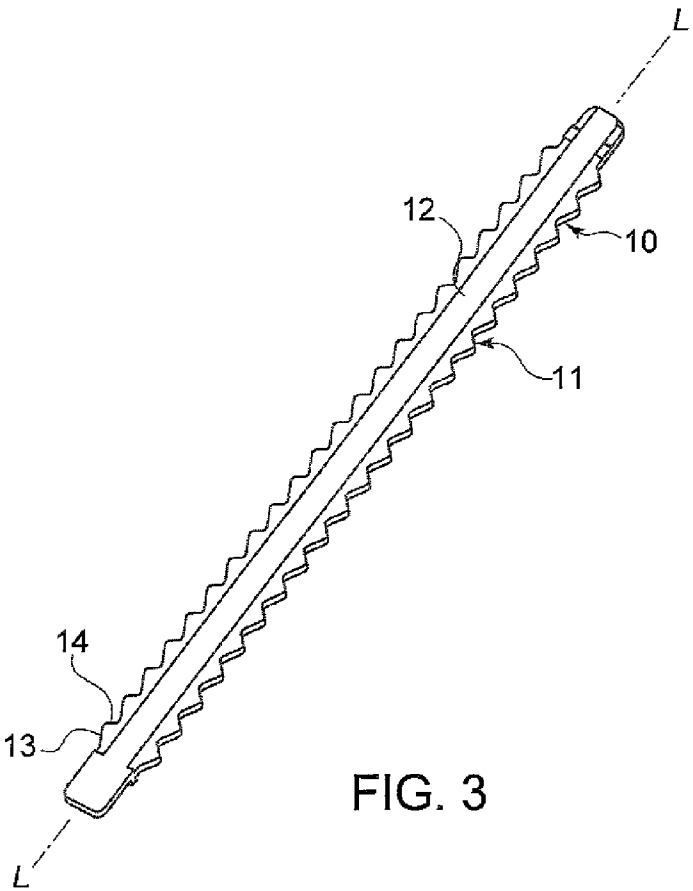
FIG. 3 shows a bottom view of the adjustment strip of FIG. 1.
Figure 2:
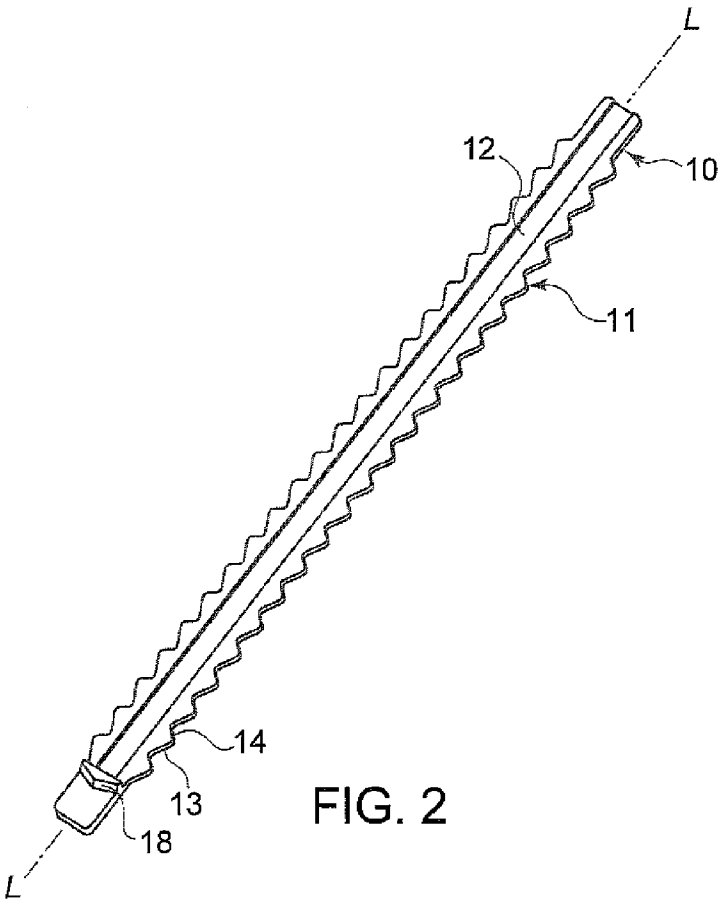
FIG. 2 shows a top view of the elongated adjustment strip according to one embodiment of the invention.
Figure 11:
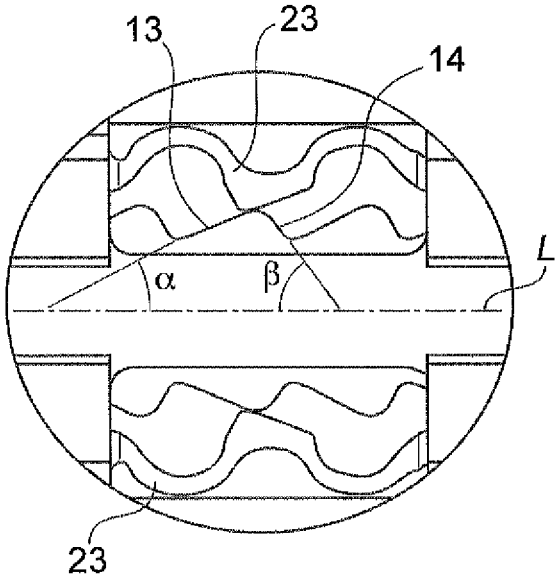
FIG. 11 shows an enlarged detail of the interaction between the springs of the locking mechanism and teeth.

FIGS. 2 and 3 show the elongated adjustment strip 10 according to one embodiment of the invention. The strip has a set of teeth 11 extending along each of the two longitudinal sides of strip 10. A central portion 12 of strip 10 is recessed on the top surface as shown in FIG. 2 and protrudes from the bottom surface as shown in FIG. 3. This way, the central portion 12 can be attached to an article along the bottom surface of strip 10 while leaving teeth 11 free. Each one of teeth 11 has a forward side 13 facing a forward direction and a rearward side 14 facing a rearward direction. Each forward side 13 is longer than each rearward side 14, so that an angle $\alpha$ between the longitudinal axis L and the forward side is less than an angle $\beta$ between the longitudinal axis L and the rearward side, as shown in FIG. 11. This creates a ratcheting type of design with the locking mechanism 20 as explained in further detail below.

On the end of strip 10 is a stop 18, which prevents further movement of locking mechanism 20 along strip 10 to keep the two components together.

Figure 4:
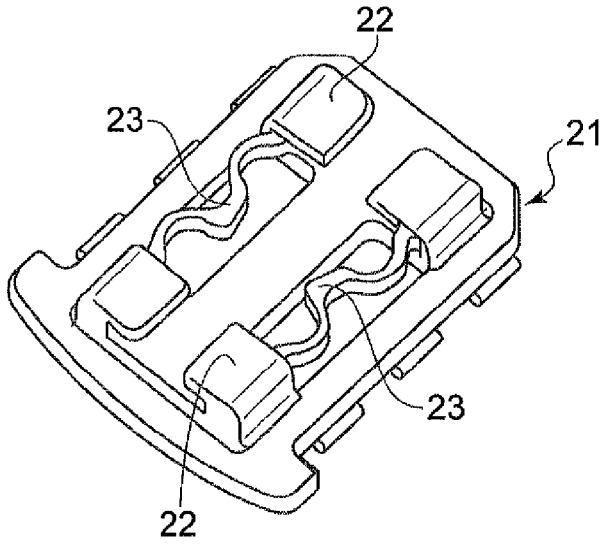
FIG. 4 shows a bottom view of one embodiment of the base plate of the locking mechanism according to the invention.
Figure 5:
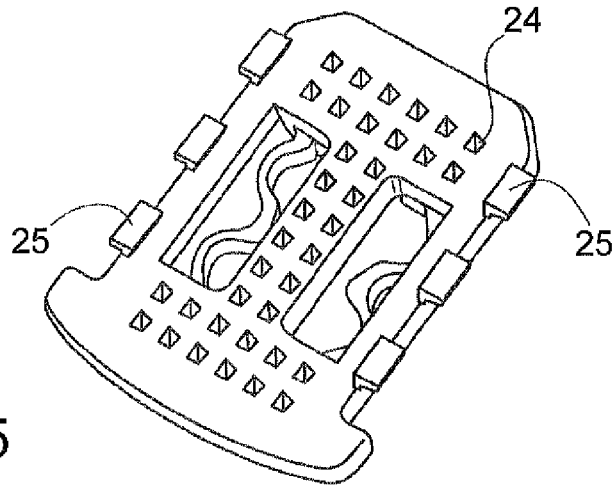
FIG. 5 shows a top view of the base plate of FIG. 4.
Figure 6:
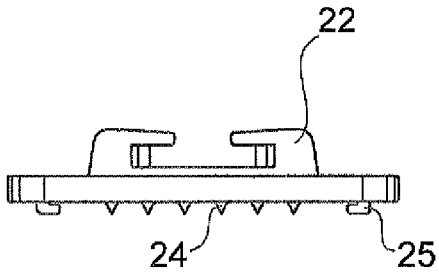
FIG. 6 shows an end view of the base plate of FIGS. 4 and 5.

The pieces of locking mechanism 20 are shown in FIGS. 4-8. FIGS. 4-6 show the base plate 21 of locking mechanism 20. Base plate 21 has a set of guides in the form of brackets 22 for receiving edges of strip 10 as locking mechanism 20 is fed along strip 10. A locking device in the form of springs 23 is disposed between guides 22. Springs 23 engage teeth 11 as locking mechanism 20 is slid along strip 10.

Figure 7:
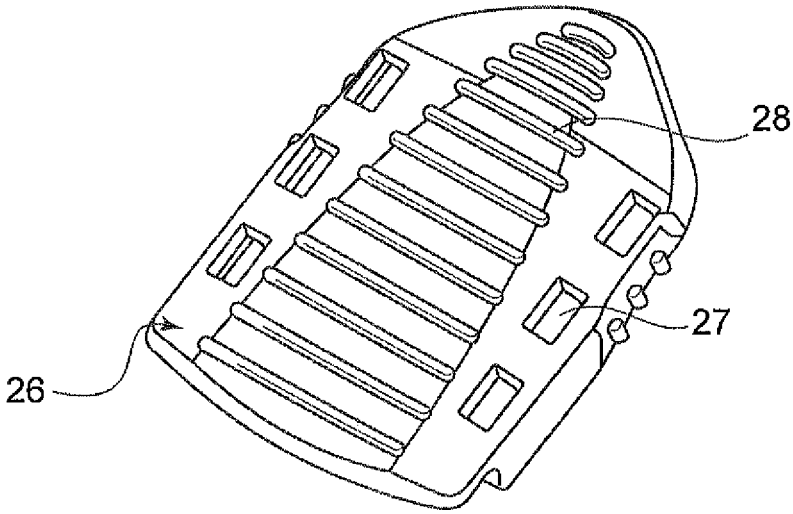
FIG. 7 shows a top view of the cover plate of the locking mechanism according to one embodiment of the invention.
Figure 8:
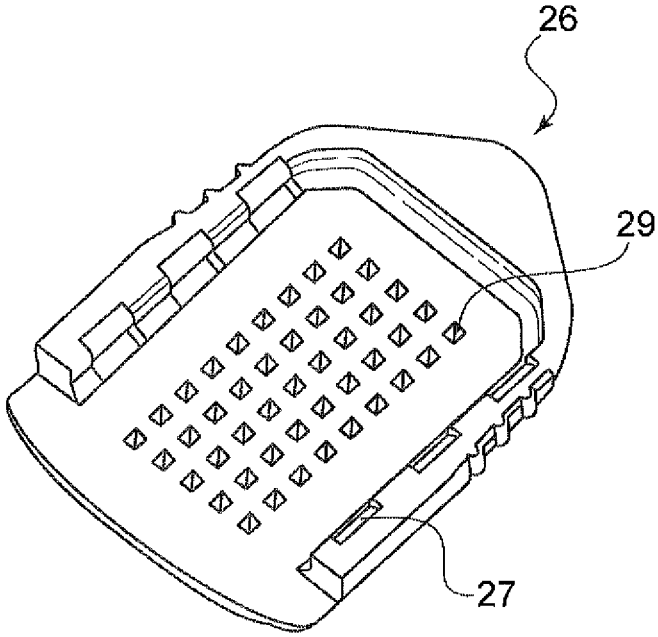
FIG. 8 shows a bottom view of the cover plate of FIG. 7.

On the top side of base plate 21 there are a plurality of fabric gripping teeth 24, and catches 25 for engaging a cover plate 26, which is shown in FIGS. 7 and 8. Cover plate 26 has a series of lateral ridges 28 along its top surface, and apertures 27 for engaging with catches 25 on base plate 21 to secure cover plate 26 to base plate 21. The underside of cover plate 26 has a plurality of fabric gripping teeth 29 as shown in FIG. 8.

Figure 9:
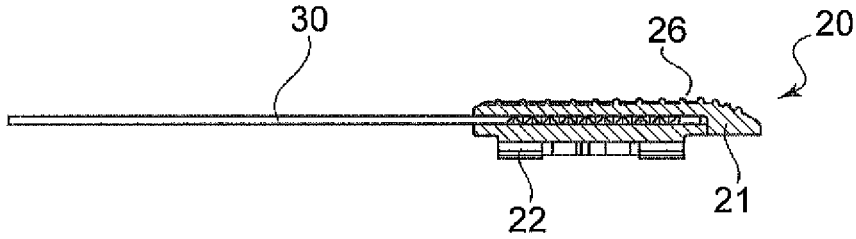
FIG. 9 shows a side cross-sectional view of the base plate and cover plate of FIGS. 5-8 attached to a strap.

As shown in FIG. 9, a strap 30 can be attached to locking mechanism 20 by placing strap 30 between cover plate 26 and base plate 21. Once catches 25 engage apertures 27, fabric gripping teeth 24, 29 grip strap 30 from the bottom and top and prevent strap 30 from releasing from locking mechanism 20.

Figure 10:
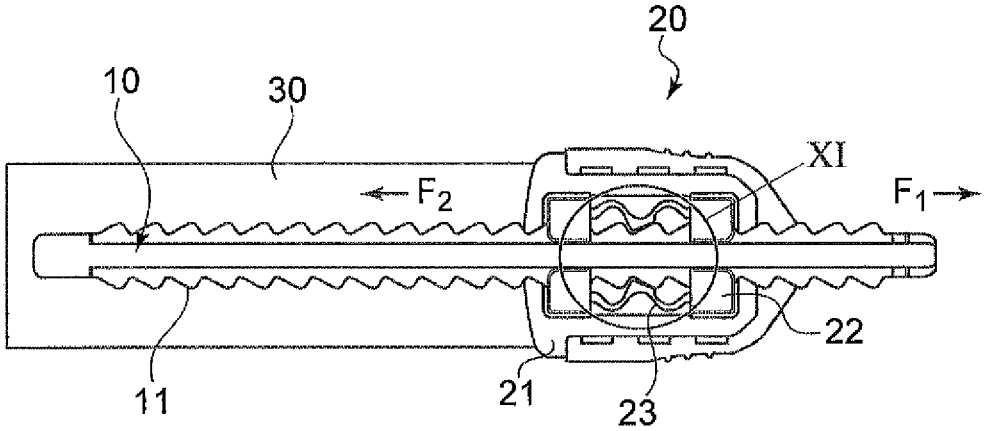
FIG. 10 shows a bottom view of the base plate of FIG. 5 connected to an elongated adjustment strip of FIG. 2.

The operation of this embodiment of the system is shown in FIGS. 10-13. As shown in FIG. 10, locking mechanism 20 is attached to strip 10 by sliding base plate 21 along strip 10 so that teeth 11 slide within guides 22 and are engaged by springs 23. Springs 23 are shaped similar to teeth 11 so that they engage teeth 11 and keep teeth 11 in place until a force that exceeds the spring force of springs 23 is applied. To move locking mechanism 20 in a forward direction along strip 10, a first amount of force F1 is applied, which causes springs 23 to flex outward and allow base plate 21 to be slid past one set of teeth until a desired position is reached, in which springs 23 engage a next set of teeth 11. The lower angle a created by forward side 13 of teeth 11 means that only a small amount of force F1 needs to be exerted on springs 23 to move springs 23 out of engagement with teeth 11, as shown in FIG. 11. In order to move locking mechanism 20 in the rearward direction, a greater amount of force F2 is required, so that springs 23 can overcome the greater angle β of the rearward side of teeth 11. Thus, it is easier to move locking mechanism 20 in the forward direction than in the rearward direction. The spring force F2 required to move locking mechanism 20 in the rearward direction should be such that no movement in the rearward direction should occur under normal use and stress, but only when releasing of the system is desired.

Figure 12:
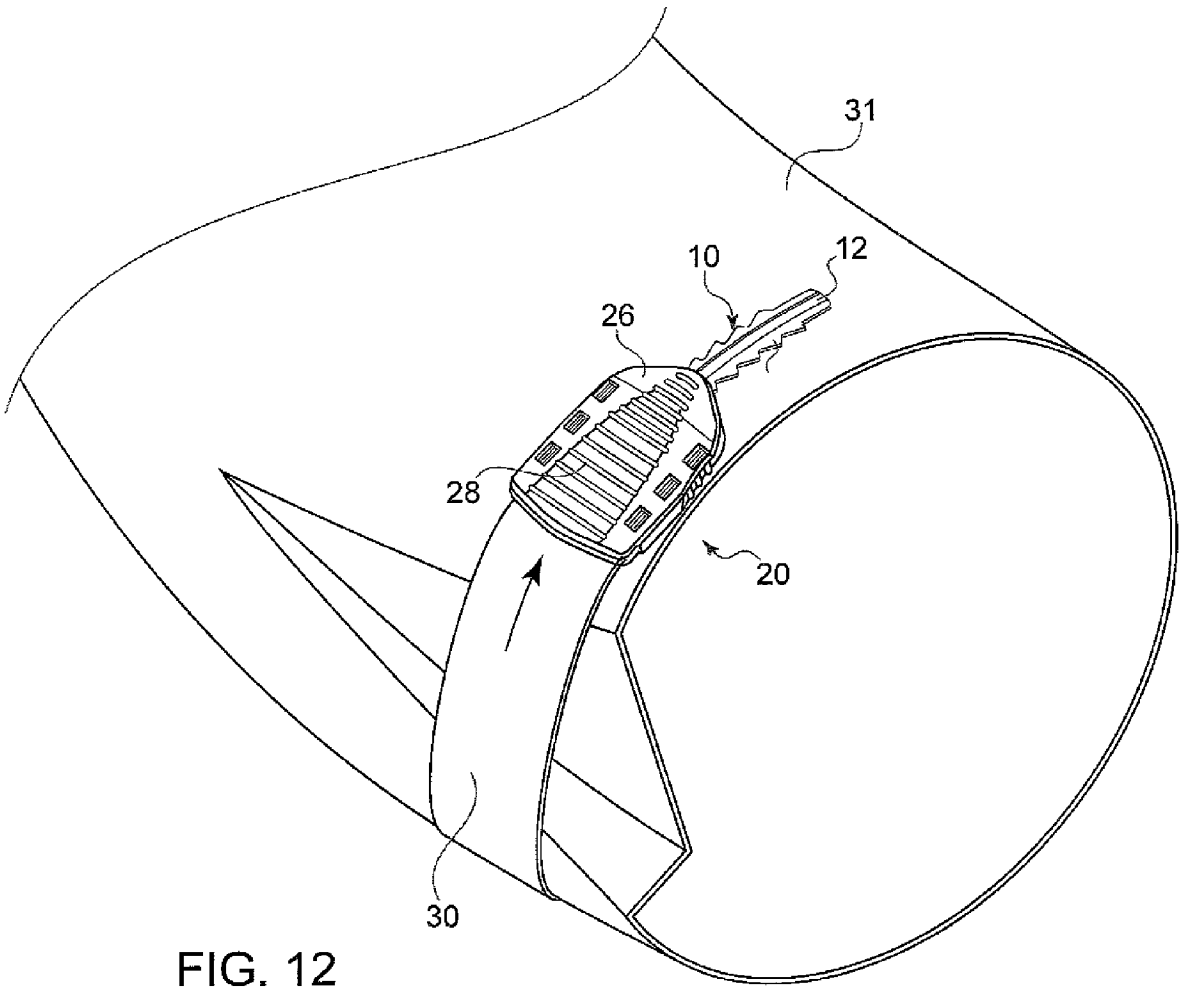
FIG. 12 shows the adjustment mechanism of FIGS. 1-11 mounted on a cuff in the open position.
Figure 13:
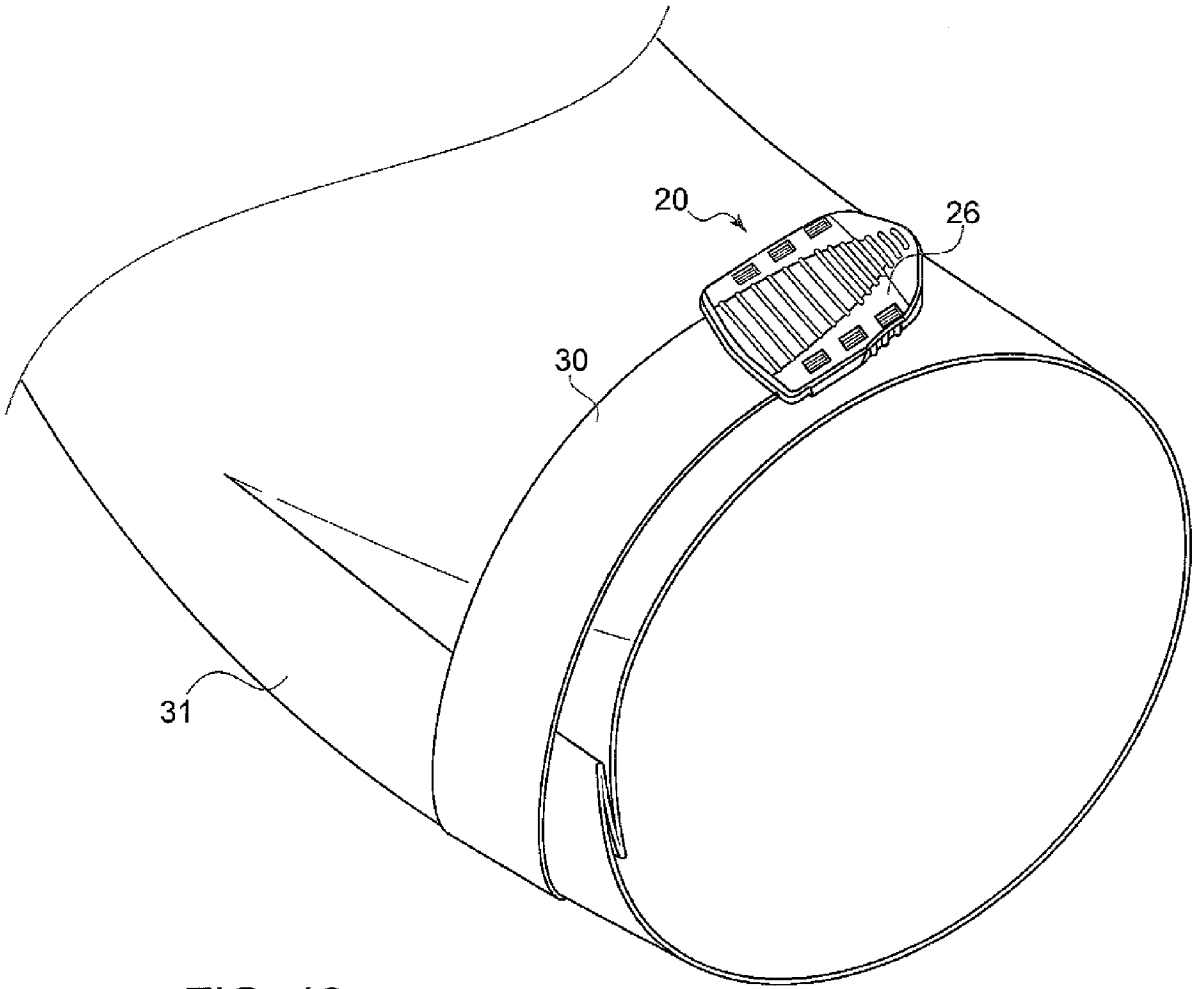
FIG. 13 shows the adjustment mechanism of FIG. 12 in the tightened position.
Figure 14:
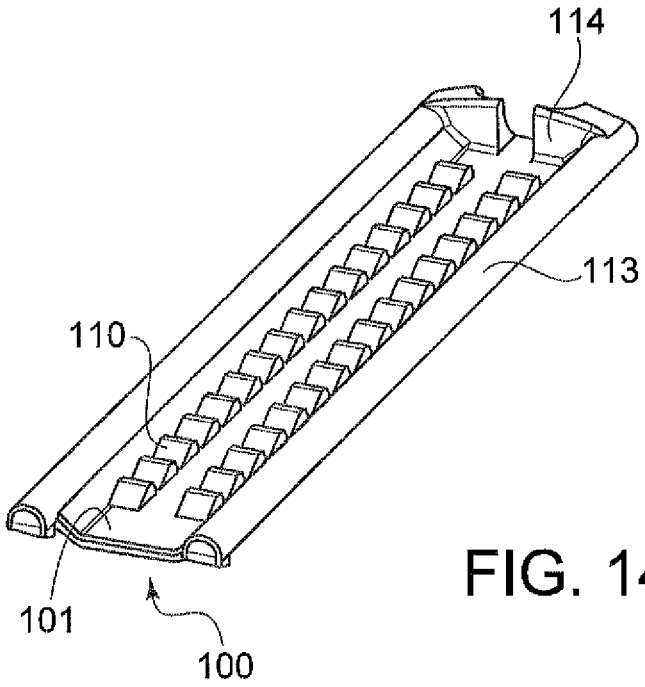
FIG. 14 shows an elongated adjustment strip according to another embodiment of the invention.
Figure 15:
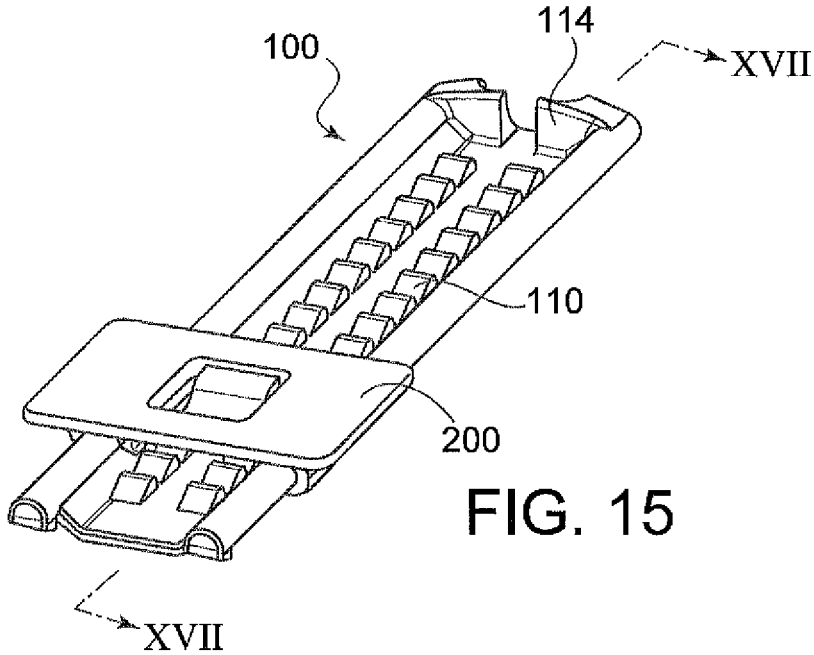
FIG. 15 shows a top view of a locking mechanism connected to the adjustment strip of FIG. 14.
Figure 16:
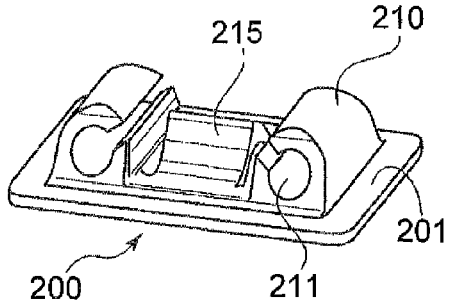
FIG. 16 shows a bottom view of the locking mechanism shown in FIG. 15.
Figure 17:
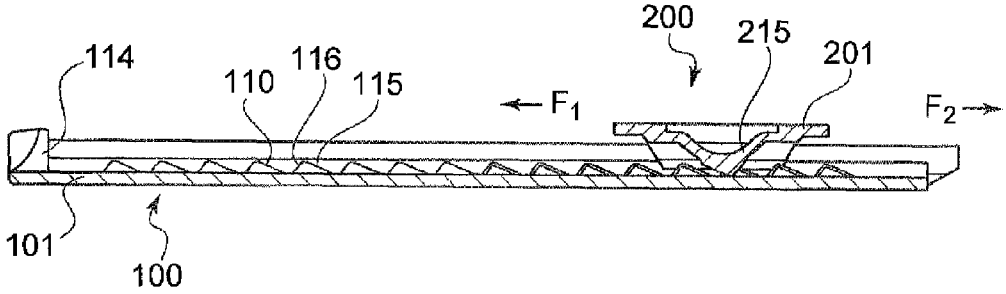
FIG. 17 shows a longitudinal cross sectional view along lines XVII-XVII of FIG. 15
Figure 18:
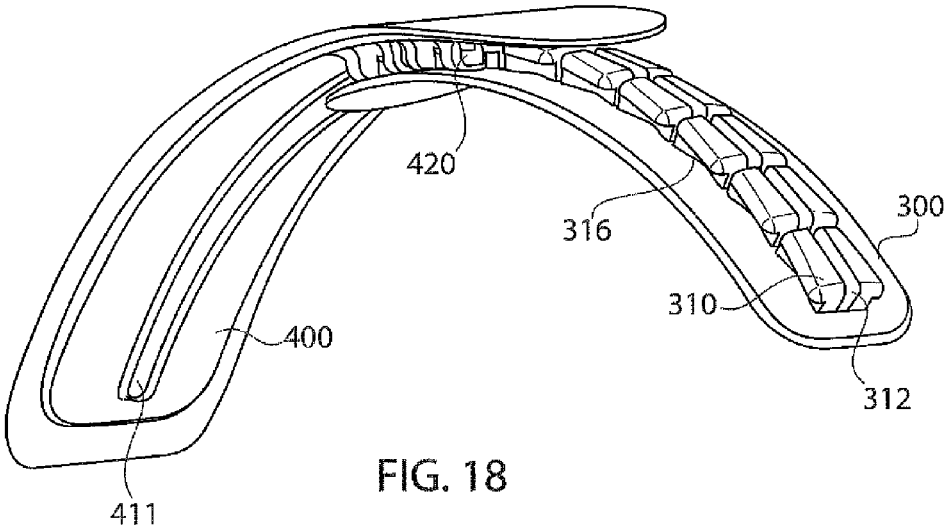
FIG. 18 shows a perspective view of another embodiment of the system according to the invention.
Figure 19:
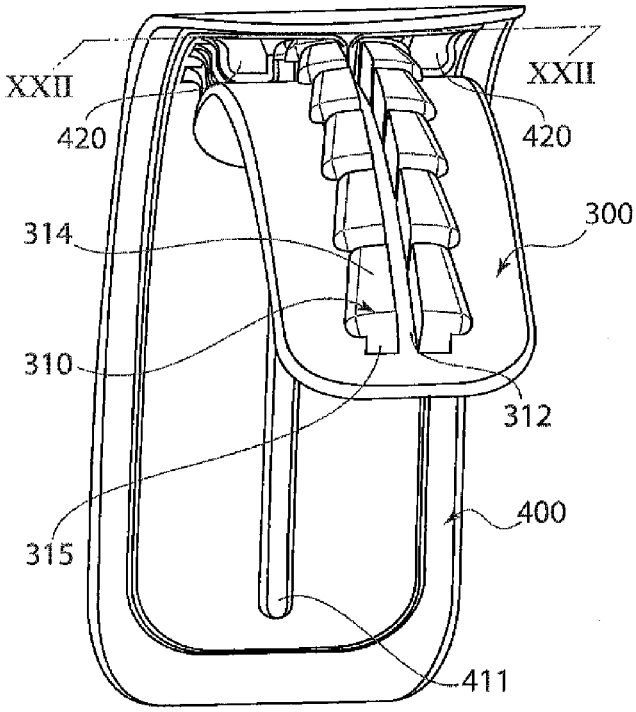
FIG. 19 show a front view of the embodiment of FIG. 18.

FIGS. 12 and 13 show the system according to the invention in use on a cuff 31. Locking mechanism 20 with cover 26 is attached to strap 30 as shown in FIG. 9 and then locking device 20 is slid along strip 10 to tighten or loosen cuff 13 the amount desired by the wearer. Lateral ridges 28 on cover plate 26 allow locking mechanism 20 to be moved forward and backward along strip 10 using only a user's finger, even when the user is wearing gloves. Thus, the system according to the invention is ideal for use on athletic apparel such as ski jackets and ski pants, where the wearers are usually wearing gloves and do not want to take them off to adjust their clothing. Pushing forward with the user's finger on cover plate 26 slides locking mechanism 20 to the desired level of tightness of cuff 31. A rearward push with a greater amount of force allows cuff 31 to be loosened again.

Strip 10 is connected to cuff 31 only along central portion 12 so that teeth 11 are free to slide within guides 22 (shown in. FIGS. 4-10) to keep locking mechanism 20 connected to strip 10.

An alternative embodiment of the system is shown in FIGS. 14-17. Here, strip 100 has a base section 101 in which a plurality of teeth 110 are mounted in two parallel longitudinal rows. Each tooth has a longer forward side 115 and a shorter rearward side 116 to form a ratcheting mechanism in the same way as the embodiment shown in FIGS. 1-13. A stop 114 is located at one end of strip 100 to prevent locking mechanism 200 from sliding off of strip 100 when it is mounted thereon. Locking mechanism 200 is mounted to strip 100 by feeding guide portions 113 on strip 100 through aperture 211 on guides 210 of locking mechanism 200. This way, locking mechanism 200 can slide along strip 200 without becoming disengaged.

On the bottom of locking mechanism 200 is a flexible arm 215 which engages teeth 110 as locking mechanism 200 is slid along strip 100. Locking mechanism 200 can move in a forward direction under a first, low amount of force F1 which causes flexible arm 215 to flex and pass over teeth 11, to tighten a cuff onto which strip 100 is mounted. A greater amount of force F2 is required to flex arm 215 enough to overcome the greater angle created by rearward side 116 of each of teeth 110 to move locking mechanism 200 in the rearward direction.

Another alternative embodiment is shown in FIGS. 18-22. Here, there is a strip 300 having a plurality of gears 310 disposed in two rows, separated by a channel 312. Each gear has a top surface 314 and a support 315. Strip 300 is slidably connected to a base 400 by sliding gears 310 into brackets 420 on base 400. To assist in the sliding, a guide ridge 411 on base 400 slides into channel 312 to keep base 400 and strip 300 aligned with each other.

Figure 20:
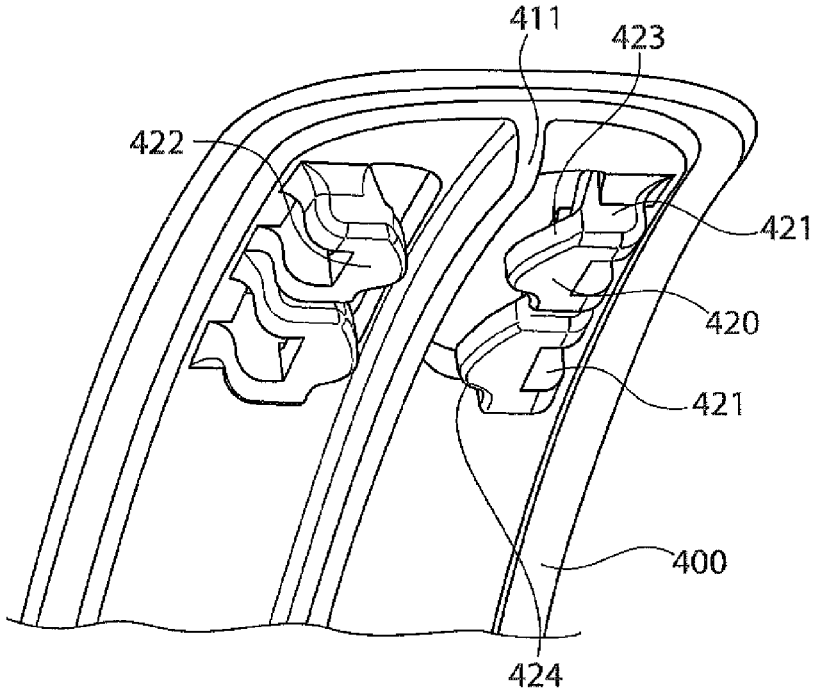
FIG. 20 shows a view of the brackets in the embodiment of FIG. 18.

The structure of brackets 420 is shown in FIG. 20. Here, there are two sets of brackets 420 disposed on either side of guide ridge 411. Each bracket 420 is comprised of flexible arms 421 and an inwardly directed tooth 422. Flexible arms 421 connect tooth 422 to base 400. Tooth 422 is structured to be generally triangular, with two sides: one side 423 facing a forward direction and one side 424 facing a rearward direction.

Figure 22:
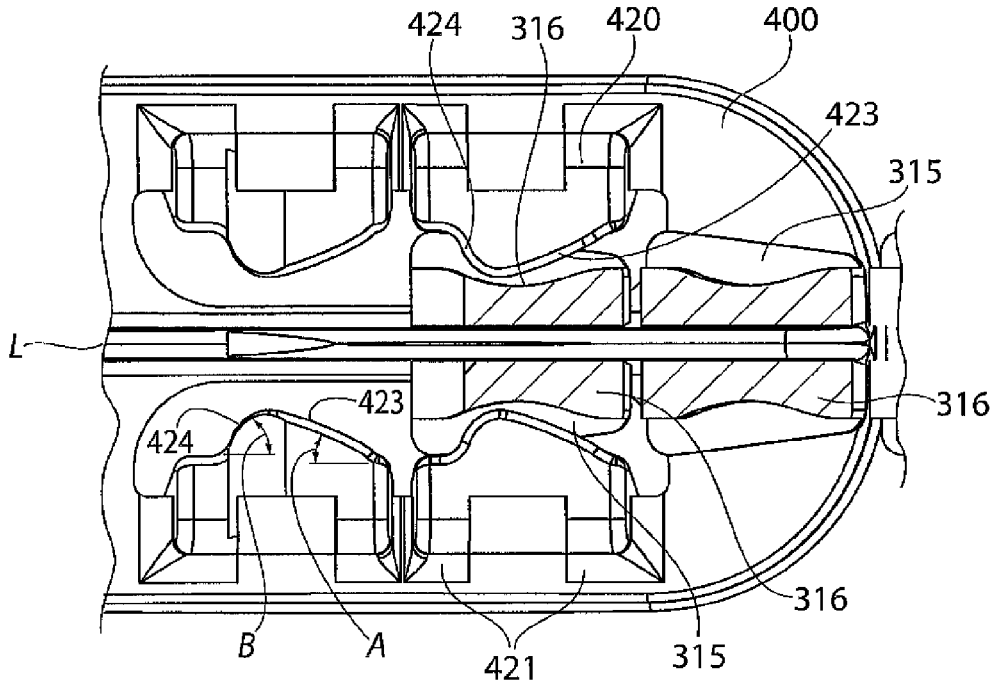
FIG. 22 shows a top cross-sectional view along lines XXII-XXII of FIG. 19, showing the teeth of the brackets engaging the gears.

As shown in FIG. 22, side 423 is structured to be longer than side 424, so that an angle A created between the longitudinal axis L of base 400 and side 423 is smaller than the angle B created between the longitudinal axis of base 400 and side 424.

Figure 21:
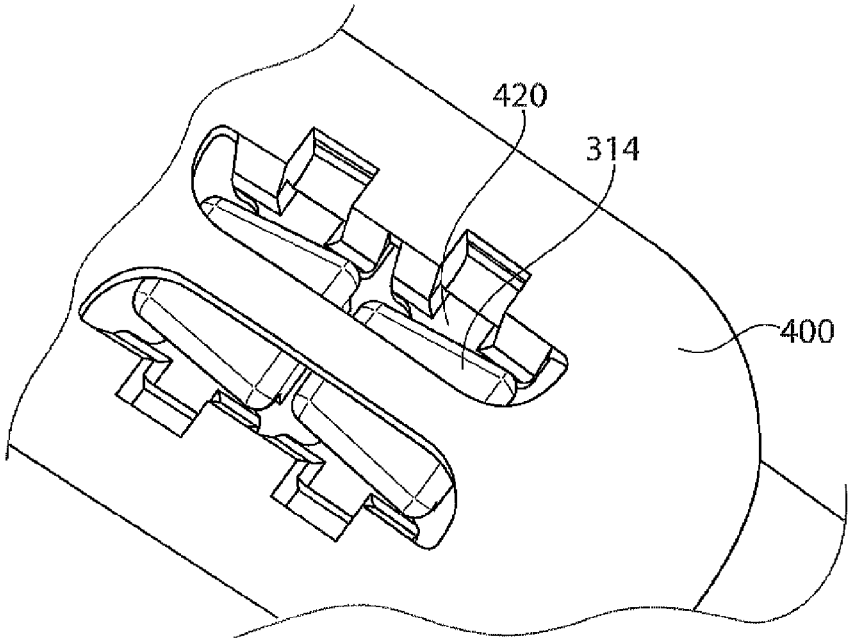
FIG. 21 shows a top view of the gears inserted into the brackets in the embodiment of FIG. 18.

As shown in FIG. 21, sliding gears 310 into brackets 420 causes the top surface 314 of the gears to rest between base 400 and tooth 422, to keep base 400 and strip 300 connected together. Strip 300 and base 400 can be adjusted relative to each other by a ratcheting mechanism created by tooth 422 and supports 315 of gears 310.

This ratcheting mechanism is shown in detail in FIG. 22. Here, the shape of support 315 can be seen in the cross-sectional view. Support 315 is dimensioned to be narrower in the middle than on the ends, creating an indentation 316 into which tooth 422 can rest. Because of the differing slopes of the sides 423 and 424 of teeth tooth 422, a different amount of force is required to move base 400 in a forward and rearward direction. When tooth 422 is resting in indentation 316, no force is required to maintain this position, as there is no pressure of support 315 against tooth 422. However, to move tooth 422 in the forward direction, a first minimum amount of force is required to push tooth past the wider ends of support 315 to move to the next gear 310. When this first minimum amount of force is exerted, arms 421 flex outward to allow tooth 422 to pass gear 310. This continues until a desired gear is reached, at which point the force can be released and tooth 422 rests in indentation 316 of the desired gear 310.

To move base 400 in the rearward direction, a second minimum amount of force is required, which is greater than the first minimum amount of force. This is due to the greater angle B of side 424 of tooth 422. This ensures that it is easier to move base a 400 in a forward rather than a rearward direction, and also ensures that base 400 and strip 300 are not inadvertently released from each other.

The device shown in FIGS. 18-22 can be used to adjust a cuff in the same way as the devices in FIGS. 1-17 are used, with the strip positioned on one portion of the cuff, and the base disposed on a strap, or vice versa. Preferably, the strip 300 and base 400 are designed curved in such a manner that the longitudinal axes of strip 300 and base 400 extends in the shape of an arc, so that they fit easily around a cuff and allow the cuff to retain its curved shape when in use. The curvature is such that the gears face. radially outward along the strip.

Accordingly, while only a few embodiments of the present invention have been shown and described, it is obvious that many changes and modifications may be made thereunto without departing from the spirit and scope of the invention.

What is claimed is:

1. An adjustment system comprising:

an elongated adjustment strip having two longitudinal sides, a plurality of gears extending along the strip, each gear having a support and a top surface, the support having an indentation in a middle section thereof;

a base having at least one bracket that comprises a flexible arm connected to at least one tooth, wherein each tooth has a forward side facing a forward direction and a rearward side facing a rearward direction, wherein a length of each of the forward sides is greater than a length of each of the rearward sides so that an angle created between a longitudinal axis of the base and the forward side is less than an angle between the longitudinal axis and the rearward side of each tooth;

wherein the strip and the base are adapted to be connected to each other by sliding the gears into the brackets so that the top surfaces of the gears are disposed between the base and the tooth of the at least one bracket, and wherein the at least one bracket is adapted to flex under a first minimum amount of force to allow the bracket to move along the strip in the forward direction to a desired position in which the tooth rests in the indentation of one of the supports when less than the first minimum amount of force is exerted, and wherein the bracket is adapted flex further under a second minimum amount of force that is greater than said first minimum amount of force to allow movement in the rearward direction.

2. The adjustment system according to claim 1, wherein the gears are arranged in two parallel rows with a guide channel between the two rows, and wherein there are a plurality of brackets arranged in two rows to engage the two rows of gears.

3. The adjustment system according to claim 2, further comprising a guide ridge extending longitudinally along the base, the guide ridge sliding in the guide channel when the gears engage the brackets.

4. The adjustment system according to claim 1, wherein the base and strip are designed curved so as to fit around a cuff.

5. The adjustment system according to claim 1, wherein and the top surface of each gear is wider than the support, so that the top surfaces of the gears are disposed between the base and the tooth of the at least one bracket when the gears are fed into the brackets.

* * * * *